US005329687A

United States Patent [19]

Scott et al.

[11] Patent Number: 5,329,687

[45] Date of Patent: Jul. 19, 1994

[54] METHOD OF FORMING A FILTER WITH INTEGRALLY FORMED RESONATORS

[75] Inventors: Richard D. Scott, Mountain View; Neal R. Knutson, San Jose, both of Calif.

[73] Assignee: Teledyne Industries, Inc., Los Angeles, Calif.

[21] Appl. No.: 968,743

[22] Filed: Oct. 30, 1992

[51] Int. Cl.[5] ..... B23P 15/00

[52] U.S. Cl. ..... 29/527.2; 174/35 R; 333/202; 427/306

[58] Field of Search ..... 29/527.2; 174/35 R; 361/386; 333/202, 203

[56] References Cited

U.S. PATENT DOCUMENTS

| | | | |
|---|---|---|---|
| 3,293,644 | 12/1966 | Loos et al. . | |
| 3,413,577 | 11/1968 | Massano . | |
| 3,505,618 | 4/1970 | McKee . | |
| 3,691,487 | 9/1972 | Yoshimoto . | |
| 3,713,051 | 1/1973 | Kell . | |
| 3,728,731 | 4/1973 | Choi et al. . | |
| 3,798,578 | 3/1974 | Konishi et al. . | |
| 3,811,101 | 5/1974 | Karp . | |
| 3,938,064 | 2/1976 | O'Bryan, Jr. et al. . | |
| 3,955,161 | 5/0476 | MacTurk | 333/73 |
| 3,973,226 | 8/1976 | Affolter et al. . | |
| 4,034,319 | 7/1977 | Olsson | 333/73 |
| 4,037,182 | 7/1977 | Burnett et al. | 333/73 |
| 4,101,854 | 7/1978 | Gikow et al. . | |
| 4,136,320 | 1/1979 | Nishikawa et al. . | |
| 4,179,673 | 12/1979 | Nishikawa et al. . | |
| 4,186,359 | 1/1980 | Kaegebein . | |
| 4,216,448 | 8/1980 | Kasuga et al. | 333/203 |
| 4,255,729 | 3/1981 | Fukasawa et al. . | |
| 4,276,525 | 6/1981 | Nishikawa et al. . | |
| 4,278,957 | 7/1981 | Starai et al. | 333/202 |
| 4,291,288 | 9/1981 | Young et al. . | |
| 4,386,328 | 5/1983 | Masuda et al. . | |
| 4,431,977 | 2/1984 | Sokola et al. . | |
| 4,455,448 | 6/1984 | Bertolina | 174/35 R |
| 4,582,729 | 4/1986 | Tsiamis et al. | 427/306 X |
| 4,626,812 | 12/1986 | Nakanishi et al. | 174/35 R X |
| 4,996,506 | 2/1991 | Ishikawa et al. . | |
| 5,045,971 | 9/1991 | Ono et al. | 361/386 |
| 5,206,796 | 4/1993 | Thompson et al. | 174/35 R X |

FOREIGN PATENT DOCUMENTS

| | | |
|---|---|---|
| 57-25701A | 2/1982 | Japan . |
| 2067848A | 7/1981 | United Kingdom . |

OTHER PUBLICATIONS

Edgar Hund, *Microwave Communications, Components and Circuits*, Chap. 5, McGraw-Hill Book Company 1989, 1 page.

(List continued on next page.)

*Primary Examiner*—Carl J. Arbes

*Attorney, Agent, or Firm*—Skjerven, Morrill, MacPherson, Franklin & Friel

[57] ABSTRACT

Method of forming a high-performance, low-cost filter is provided. The filter comprises a housing and a cover. The housing defines a cavity in which one or more rods are disposed, one end of each rod being integrally formed with the housing. The rods function as coaxial resonators. A cover, disposed over the cavity, is securable to the housing. Input and output signal leads are coupled in conventional configurations to the rods. In one embodiment, the housing and cover are formed from a moldable dielectric material, such as plastic, which is then plated with a conductive film. In another embodiment, the housing is formed from a moldable dielectric material which is then plated with a conductive film while the cover is formed from a conductive material. The present invention provides optimal performance by using air as a dielectric separating the rods which function as coaxial resonators. Moreover, the moldable housing minimizes the number of components in the filter and provides a cost-effective manufacturing process. The use of a low cost, moldable material for the housing, such as plastic, further reduces the cost of manufacturing the filter.

16 Claims, 7 Drawing Sheets

OTHER PUBLICATIONS

William Sinnema, *Electronic Transmission Technology,* "Transients On A Lossless Transmission Line", pp. 20–27, Prentice–Hall, Inc. 1979.

Lawrence N. Dworsky, *Modern Transmission Line Theory And Applications,* "The Transmission Line Equations", Preface and Chap. 1, pp. 1, John Wiley & Sons, Inc. 1979.

Mitsuo Makimoto and Sadahilo Yamashita, "Compact Bandpass Filters Using Stepped Impedance Resonators", *Proceedings Of The IEEE,* vol. 67, No. 1, pp. 16–19, Jan. 1979.

Howard M. Berlin, *Design Of Active Filters, With Experiments,* Preface and pp. 142–143 and 156–157, Howard W. Sam & Co., Inc. 1977.

Robert J. Wenzel, "Synthesis of Combline and Capacitively Loaded Interdigital Bandpass Filters of Arbitrary Bandwith", *IEEE Transactions On Microwave Theory And Techniques,* vol, MTT–19, No. 8, pp. 678–686, Aug. 1971.

P. A. Matthews, I. M. Stephenson, *Microwave Components,* "Cavity Resonators And Filters", pp. 120–121, Chapman and Hall Ltd. 1968.

P. A. Matthews, I. M. Stephenson, *Microwave Components,* "Transmission Line Theory", pp. 42–45, Chapman and Hall Ltd. 1968.

Edward G. Cristal, *IEEE Transactions On Microwave Theory And Techniques,* "Data for Partially Decoupled Round Rods Between Parallel Ground Planes", pp. 311–314, May 1968.

Edward G. Cristal, *IEEE Transactions On Microwave Theory and Techniques,* "Coupled Circular Cylindrical Rods Between Parallel Ground Planes" pp. 428–439, Jul. 1964.

METHOD OF FORMING A FILTER WITH INTEGRALLY FORMED RESONATORS

BACKGROUND OF THE INVENTION

1. Field of the Invention

This invention relates to microwave filters and in particular to combline) filters.

2. Description of the Related Art

Filters are electronic circuits which allow electronic signals of certain frequencies, called a "passband", to pass through the filter, while blocking or attenuating electronic signals of other frequencies. FIG. 1 illustrates a conventional bandpass filter 100 disclosed by U.S Pat. No. 4,431,977 issued on Feb. 14, 1987 to Sokola et al. Filter 100 includes a block 110 formed from a dielectric material that is selectively plated with a conductive material (i.e. plated with the exception of areas 140). Block 110 includes holes 101–106 which each extend from the top surface to the bottom surface. Holes 101–106 are also plated with the conductive material.

Coupling between the coaxial resonators provided by plated holes 101–106 in FIG. 1 is accomplished by varying the width of the dielectric material between adjacent coaxial resonators. Specifically, the width of the dielectric material between adjacent holes 101–106 is adjusted by the use of slots 110–114. RF signals are capacitively coupled to and from filter 100 in FIG. 1 by means of input and output electrodes 124 and 125 and corresponding input and output connectors 120 and 122. The resonant frequency of the coaxial resonators provided by holes 101–106 is determined primarily by the depth of hole 104, the thickness of block 110 in the direction of hole 104, and the amount of plating removed from the top of filter 100 near hole 104. Tuning of filter 100 is accomplished by the removal of additional ground plating near the top of each plated hole.

Filter 100 is typically fabricated from expensive dielectric materials, such as barium oxide, titanium oxide, or zirconium oxide, thereby significantly increasing manufacturing costs. Moreover, these dielectric materials are physically heavy, thereby rendering filter 100 inappropriate for applications involving a payload, such as in space, where weight is critical. Futhermore, machining dielectric block 110 to a predetermined size and removing the plating to tune filter 100 requires specialized, i.e. costly, equipment and additional labor, thereby further increasing manufacturing costs.

Additionally, the use of a solid dielectric block, such as block 100 disclosed by Sokola et al., exhibits an insertion loss, i.e. how much signal energy is lost as the signal passes through the filter, which varies significantly based on the type of dielectric material used. Specifically, those skilled in the art recognize that the insertion loss of a filter is inversely proportional to the quality factor Q. Thus, the higher the quality factor Q, the lower the insertion loss. The equation below provides the total quality factor $Q_{Total}$ of filter 100:

$$\frac{1}{Q_{Total}} = \frac{1}{Q_C} + \frac{1}{Q_D} \qquad \text{Eq. 1}$$

where $Q_C$ is the quality factor of the conductive plating and $Q_D$ is the quality factor of the dielectric block 100. A typical filter 100 has a quality factor $Q_C$ equal to 1000. However, quality factor $Q_D$ ranges from 1500 to 8000. Substituting these values into Equation 1 yields a total quality factor $Q_{Total}$ which ranges from 600 to approximately 888. Although a higher quality factor $Q_D$ of the dielectric increases the total quality factor $Q_{Total}$, Equation 1 demonstrates that the presence of any dielectric, irrespective of the value of $Q_D$, in filter 100 necessarily decreases the total quality factor $Q_{Total}$, thereby increasing the insertion loss of filter 100.

Thus, a need arises for a filter fabricated from a low-cost, lightweight material which is easily manufactured and yet provides high performance.

SUMMARY OF THE INVENTION

The present invention provides a high performance, low-cost filter and a cost effective method for manufacturing this filter.

The filter comprises a housing and a cover. The housing defines a cavity in which one or more rods are disposed, one end of each rod being integrally formed with the housing. A cover, disposed over the cavity, is securable to the housing. Input and output signal leads are connected to the housing and predetermined rods. In other embodiments of the present invention, input and output signal leads are connected to the housing and are either capacitively or inductively coupled to predetermined rods.

In one embodiment, the housing and cover are formed from a moldable material, such as a plastic having predetermined thermal properties, which is then plated with a conductive layer. In another embodiment, the housing is formed from the moldable material which is then plated with the conductive layer while the cover is formed from a suitable conductive material, such as aluminum.

The present invention significantly reduces manufacturing costs by eliminating the expensive dielectric materials used in prior art filters. Moreover, because the housing is moldable, additional cost savings are realized by eliminating prior art manufacturing costs associated with machining and tuning a solid dielectric filter.

Furthermore, the present invention improves electrical performance of the filter by using air as the dielectric separating the rods (which function as coaxial resonators). Specifically, the quality factor associated with the dielectric of prior art filters is eliminated. Thus, the total quality factor of a filter in accordance with the present invention is increased, thereby decreasing the insertion loss.

Moreover, because the electrical properties of air exhibit less variance in response to temperature changes than a solid dielectric, the present invention reduces the drift exhibited by some prior art filters. Finally, because the housing is formed from a lightweight material, such as plastic, and air is used as the dielectric, a filter in accordance with the present invention is extremely light-weight.

DETAILED DESCRIPTION OF THE DRAWINGS

Figure 1:
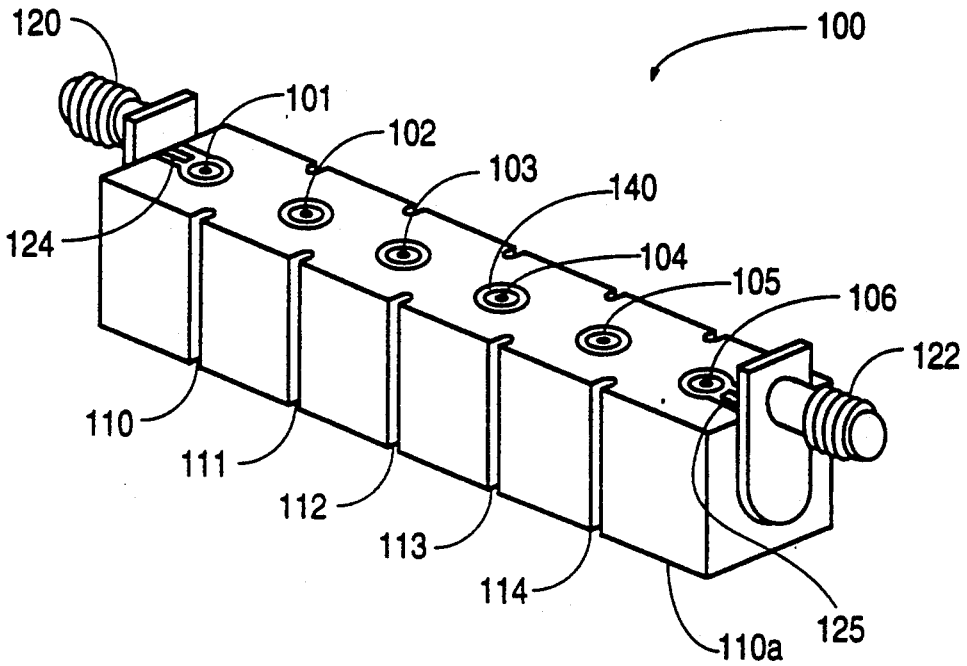
Figure 1 PRIOR ART
FIG. 1 illustrates a prior art filter formed from a solid dielectric block.
Figure 2:
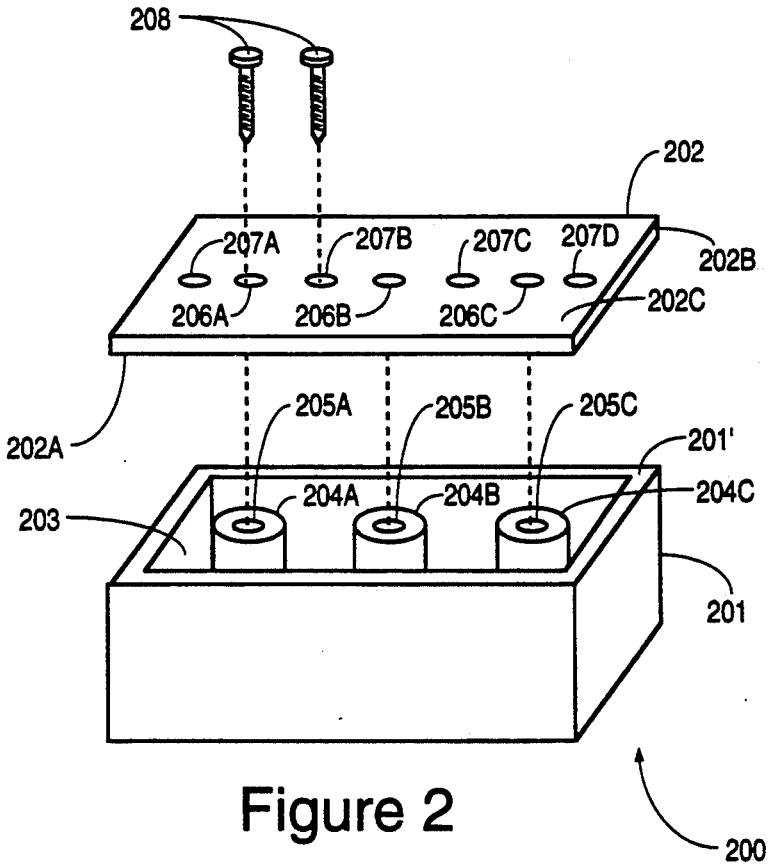
FIG. 2 illustrates an exploded perspective view of one filter in accordance with the present invention.

In accordance with the present invention, a filter 200 shown in FIG. 2 includes a housing 201 and a cover 202. Housing 201 defines a cavity 203 in which rods 204 are disposed. Each rod 204 has one end integrally formed with housing 201. The other end of rod 204 extends into cavity 203 and is positioned in operative relation to cover 202.

Figure 3A:
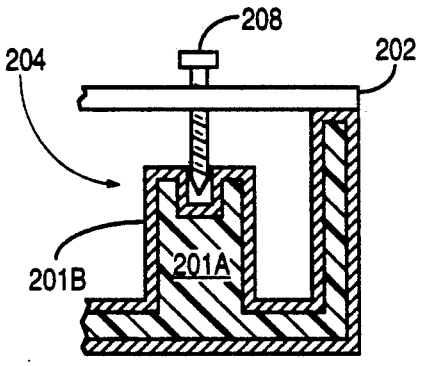
FIGS. 3A–3D show various cross-sectional views of a portion of a filter in accordance with the present invention.

In one embodiment of the present invention and referring to FIG. 3A, housing 201 includes an injection molded plastic framework 201A having strength and thermal expansion characteristics comparable to aluminum. This thermal expansion characteristic allows framework 201A to be plated with a conductive layer 201B. The process of plating framework 201A is described below in further detail. One plastic exhibiting the above-described properties is a glass fiber reinforced polyethermide resin sold under the trade name ULTEM resin and is currently available from General Electric. Other embodiments of the present invention may include other moldable materials having the above-described properties.

Note that minor discontinuities or gaps in conductive layer 201B, particularly in the openings 205 in rods 204 (FIG. 2) may occur during the plating processing, but will not substantially affect the performance of filter 200. Note that only the surface of housing 201 inside cavity 203, the lip 201' of housing 201, and the area where a connector (not shown, but explained in detail in reference to FIGS. 8A–8C) is located must be plated. However, selective plating requires the use of plating masks which increase manufacturing cost. Thus, housing 201 is typically plated on all surfaces.

Cover 202 includes a plurality of holes 206 and 207 which extend completely through cover 202. Holes 206 are aligned with rods 204. For example, hole 206B is aligned with opening 205B in rod 204B. A tuning device 208, in one embodiment a conductive screw, is screwed through hole 206B, for example, so as to be positioned in operative relation to the opening 205B. The further tuning device 208 extends into opening 205B (without touching rod 204B), the lower the frequency of the resonator provided by plated rod 204B. Conversely, the less tuning device 208 extends into opening 205B, the higher the frequency of the resonator. Thus, by providing tuning devices 208 in holes 206, the frequency of filter 200 is tuned. Note that opening 205 may vary in length. Typically, opening 205 is formed deep enough to allow tuning device 208 to be inserted such that a predetermined capacitance, and hence frequency, is achieved.

Figure 3B:
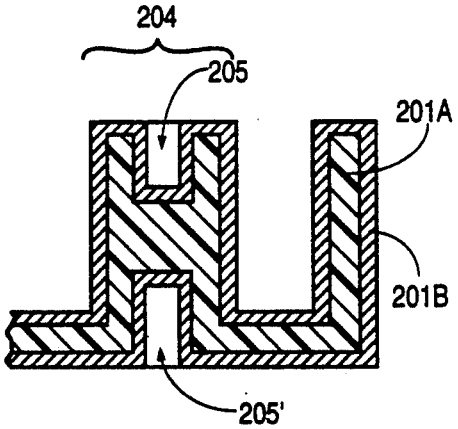
Figure 3C:
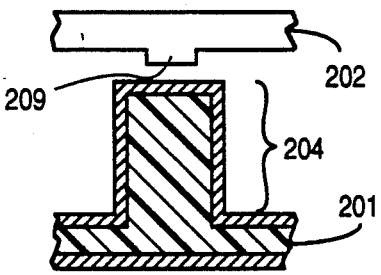
Figure 3D:
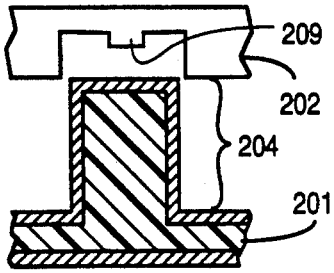

In one embodiment of the present invention, to minimize shrinking of housing 201 during fabrication, all walls of housing 201 have identical thickness as shown in FIG. 3B. Thus, in this embodiment and referring also to FIG. 2, housing 201 has opening 205 in rod 204 inside cavity 203 and opening 205' in rod 204 outside cavity 203. In other embodiments of the present invention, shown in FIGS. 3C and 3D, rod 204 has no opening 205 and is tuned to a predetermined frequency by protrusions 209 on cover 202 (explained in detail in reference to FIG. 4).

Referring back to FIG. 2, holes 207 are positioned adjacent holes 206. In this manner, if a tuning device 208 is screwed through hole 207B, for example, tuning device 208 extends into cavity 203 between rods 204A and 204B. The further tuning device 208 extends into cavity 203, the greater the inductive coupling between rods 204A and 204B, thereby increasing the bandwidth of filter 200. Conversely, the less tuning device 208 extends into cavity 203, the less the inductive coupling between rods 204A and 204B, thereby increasing the bandwidth of filter 200. Thus, by providing tuning devices 208 in holes 207, the bandwidth of filter 200 is adjusted. The number of tuning devices 208 in holes 207 is n-1, where n is the number of rods 204. Note that tuning device 208 is typically formed from a base layer such as brass, steel, aluminum, or plastic, and then plated with a conductive material, such as silver. After tuning of filter 200, tuning devices 208 are potted with epoxy.

Housing 201 and rods 204 are formed in a single piece by conventional molding processes. Molding processes, including injection and compression molding, are well known in the art and therefore are not described in further detail. As mentioned previously, housing 201 and rods 204 are then plated with a conductive layer 201B (FIGS. 3A–3D). For an embodiment using ULTEM resin to form housing framework 201A, conductive layer 201B is typically applied using one of two methods. In one method, conductive layer 201B includes three layers deposited by vacuum metallization. During vacuum metallization and referring to FIG. 5A, a first layer of metal, such as aluminum, is deposited in step 501 to a thickness of approximately 1 μm on the surface of housing framework 201A. An intermediate layer of, for example, copper or nickel is then deposited in step 502 to a thickness of approximately 4 μm to provide an adhesive link between the first layer of metal and the final layer of metal, deposited in step 503, which is preferably silver. Generally, the final layer of metal is between approximately 16 to 24 μm thick.

Figure 5B:
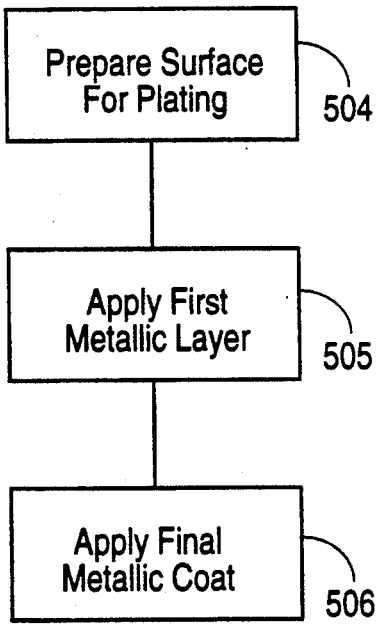
FIGS. 5A and 5B show flow charts describing the steps for plating the housing and/or cover in the present invention.
Figure 5A:
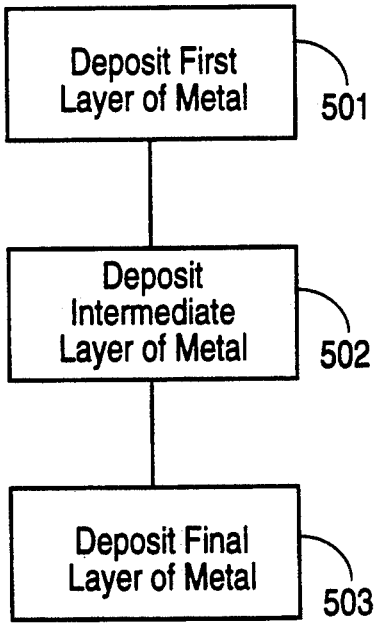

In another method of applying conductive layer 201B and referring to FIG. 5B, housing framework 201A is prepared in step 504 for plating by grit or bead blasting the surface of housing framework 201A. Then, a first metallic layer of, for example, electroless copper is deposited in step 505 to a minimum thickness of approximately 1 μm. Following deposition of the first metallic layer, a final metallic layer, for example silver, is deposited on the first metallic layer to a thickness of approximately 16 to 24 μm. Note that the final metallic layer (steps 503 and 506) may include other comparable metals, such as gold, copper, or aluminum.

Figure 6A:
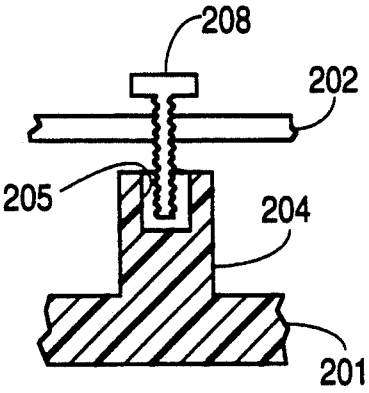
FIGS. 6A and 6B are partial cross-sectional views illustrating two of tuning a resonator, i.e. rod, of the present invention.
Figure 6B:
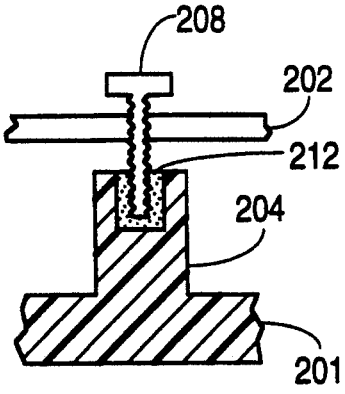

Table I below summarizes performance characteristics, i.e. temperature stability, of housing 201 (in this example formed with ULTEM and plated using either of the two methods described above) compared to a conventional aluminum housing. It is well known in the art that a filter is typically "air-tuned" or "dielectric-tuned". In an air-tuned filter and referring to FIG. 6A, tuning device 208 is screwed through cover 202 into opening 205 in rod 204. Note that tuning device 208 does not touch rod 204, thereby providing capacitive coupling between tuning device 208 and rod 204 through air. As mentioned previously, the position of tuning device 208 relative to rod 204 determines the frequency of the resonator as provided by rod 204. In a dielectric-tuned filter and referring to FIG. 6B, tuning device 208 is screwed through cover 202 into a dielectric sleeve 212 which is placed in opening 205 of rod 204. Thus, capacitive coupling is provided between rod 204 and tuning device 208 through dielectric sleeve 212. This configuration provides more structural stability than the configuration shown in FIG. 6A because tuning device 208 is secured in rod 204 by dielectric sleeve 212. In one embodiment, dielectric sleeve 212 is formed from TEFLON. In other embodiments, other low-loss dielectric materials are used to form sleeve 212. Table I below compares both air-tuned and dielectric-tuned filters.

TABLE I

| Test Temperature | Aluminum Housing (air tuned) | ULTEM Housing (air tuned) | ULTEM Housing (dielectric tuned) |
|---|---|---|---|
| −35° C. | +1.8 MHz | +3.8 MHz | +0.3 MHz |
| +85° C. | −2.0 MHz | −1.1 MHz | −1.5 MHz |

As shown in Table I, housing 201 provides comparable performance characteristics with a conventional aluminum housing if housing 201 is air-tuned. If housing 201 is dielectric-tuned, housing 201 has significantly improved performance characteristics compared to the conventional aluminum housing. Because housing 201 is molded, the cost of manufacturing housing 201 is significantly less than the machining costs associated with the conventional aluminum housing. Thus, the present invention provides comparable or even enhanced performance at a fraction of the cost associated with conventional aluminum filters.

In one embodiment of the present invention, cover 202 is injection molded and then plated with a conductive layer in a manner similar to housing 201. Note that only the surface 202A of cover 202 facing cavity 203 and holes 206, 207 must be plated. In other words, surfaces 202B and 202C of cover 202 need not be plated. However, selective plating requires the use of plating masks which increases manufacturing cost. Thus, cover 202 is typically plated on all surfaces.

Figure 4:
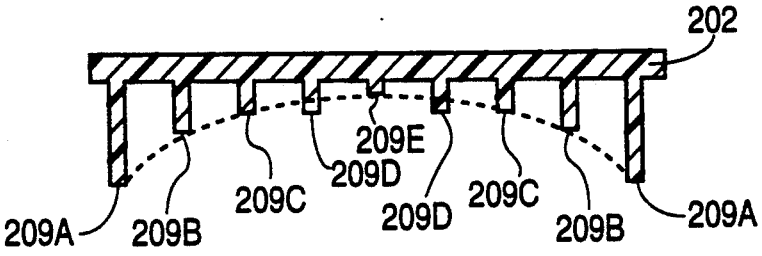
FIG. 4 illustrates a cross-sectional view of one embodiment of a cover in accordance with the present invention.

In another embodiment of the present invention shown in FIG. 4, protrusions 209 are formed integrally with cover 202 and serve a function equivalent to tuning devices 208 (FIG. 2). In this manner, cover 202 with protrusions 209 provides pre-tuning of both the frequency and the bandwidth of filter 200. Note that because rods 204 are typically uniform in filter 200 (FIG. 2), protrusions 209 are varied in length across cover 202. Specifically, more capacitance is required for tuning the frequency at the outer rods of filter 200 and thus outer protrusions 209A are longer than protrusions 209C. The filter requires the least capacitance in the middle and thus protrusion 209E is shorter than protrusions 209C. Therefore, protrusions 209A, 209C, and 209E typically have a paraballic profile as shown in FIG. 4. Note protrusions 209B and 209D tune the bandwidth and therefore are typically of uniform length.

In yet another embodiment of the present invention, cover 202 is formed from a conductive material, such as aluminum. Because forming cover 202 in this embodiment only entails machining or stamping a flat piece of material, the manufacturing cost is comparable to injection molding the same part.

Figure 7A:
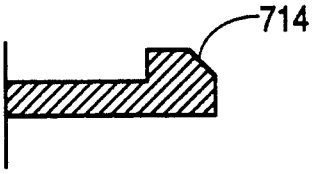
FIGS. 7A–7I illustrate various means in accordance with the present invention to secure the cover to the housing.
Figure 7B:
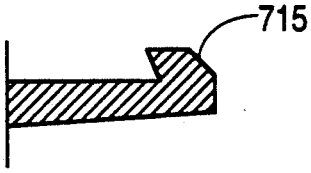
Figure 7C:
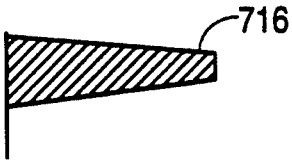

The use of plastics in the present invention provides the advantage of snap-fit assembly. Specifically, tabs 714, 715 and 716 shown in FIGS. 7A, 7B, and 7C, respectively, are molded with either housing 201 or cover 202 (FIG. 2). Note that the component not having a tab is formed with a suitable indentation for securing the tab. FIG. 7A shows a tab 714 having a constant cross-section. FIG. 7B shows a tab 715 having a tapered cross-section, while FIG. 7C shows a tab 716 having a tapered width. As is well known in the art, strain is minimized by providing a flexible tab. Flexibility is typically achieved by tapering the thickness, the width, or both the thickness and width of the tab. Moreover, tapering the thickness more evenly distributes the stress in the tab.

Conventional aluminum filters use metal screws to secure the housing to the cover. However, in accordance with the present invention, tabs 714, 715, or 716 eliminate these screws, thereby dramatically reducing the number of components in the filter. Thus, mating parts, i.e. housing 201 and cover 202, are assembled rapidly and economically on the assembly line or at the final use location.

In another embodiment of the present invention, housing 201 and cover 202 are bonded together by any of a number of commercially available conductive adhesives. These adhesives include, for example, silver-filled epoxies or conductive RTVs. In another embodiment, housing 201 and cover 202 are bonded together with solvent before being plated, wherein the end result after the solvent has evaporated is a substantially resin-to-resin bond with no intermediate material. A typical solvent is methylene chloride.

Figure 7D:
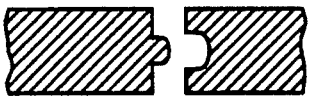
Figure 7E:
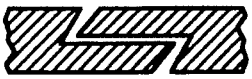
Figure 7F:
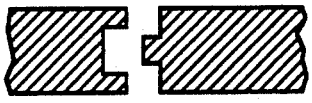
Figure 7G:
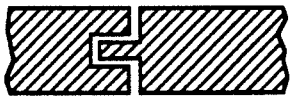
Figure 7H:
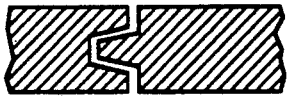
Figure 7I:
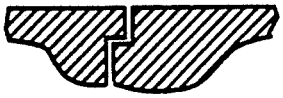

In the embodiments using adhesives or solvents, housing 201 and cover 202 are formed in a predetermined configuration such that these two components fit precisely after being molded. FIGS. 7D–7I illustrate typical joint configurations for either solvent or adhesive bonding of housing 201 and cover 202. FIG. 7D shows a rounded tongue and groove configuration, FIG. 7E illustrates a double scarf lap, FIG. 7F shows a tube tongue and groove configuration, FIG. 7G illustrates a conventional tongue and groove configuration, FIG. 7H shows a landed scarf tongue and groove configuration, and FIG. 7I illustrates a wall tongue and groove configuration. Note that both solvent and adhesive bonding, like forming tabs on housing 201 and cover 202, also eliminate prior art screws and therefore also provide an extremely cost-effective assembly of filter 200.

In yet another embodiment of the present invention, threaded fasteners, i.e. molded threads from the plastic used for housing 201 or self-tapping screws, secure housing 201 and cover 202 together. In other embodiments, molded inserts, ultrasonic inserts, ultrasonic bonding, or ultrasonic staking may be used. A publication entitled, Ultem Resin Design Guide, by General Electric Plastics discloses additional information regarding these methods and is herein incorporated by reference in its entirety.

Figure 8A:
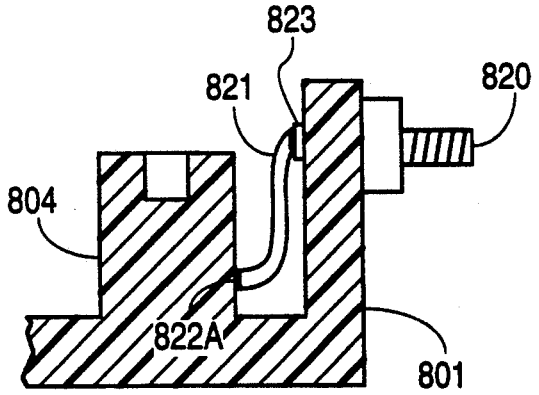
FIGS. 8A–8C are partial cross-sectional views showing various methods of coupling a connector to a rod.
Figure 8B:
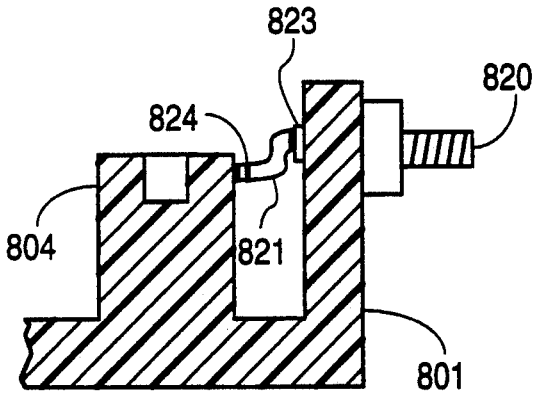
Figure 8C:
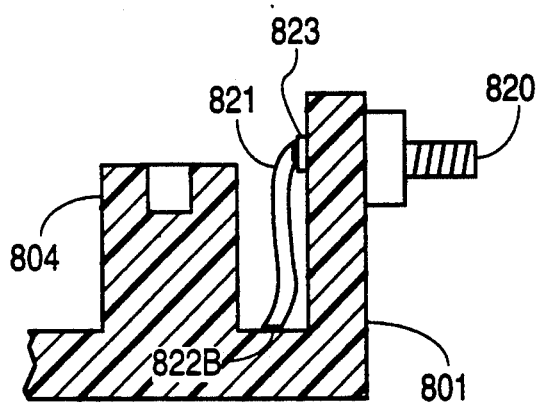

FIGS. 8A–8C illustrate typical methods of providing RF signals to a filter in accordance with the present invention. FIG. 8A shows a direct tap configuration. As shown in FIG. 8A, connector 820, secured to housing 801 in a conventional manner, is directly connected to rod 804 by a ribbon 821 having one end soldered to the center conductor 823 of connector 820 and having another end soldered to rod 804 at point 822A. FIG. 8B illustrates a capacitive coupling configurement. Referring to FIG. 8B, connector 820 is capacitively coupled to rod 804 by ribbon 821 having one end soldered to center conductor 823 and having another end coupled to capacitor 824 which is secured to rod 804. Finally, FIG. 8C illustrates an inductive coupling (loop) configuration. As shown in FIG. 8C, connector 820 is inductively coupled to rod 804 by ribbon 821 having one end soldered to center conductor 823 and having another end soldered to housing 801 at point 822B. Note that ribbon 821 in other embodiments of the present invention is a wire.

Figure 9A:
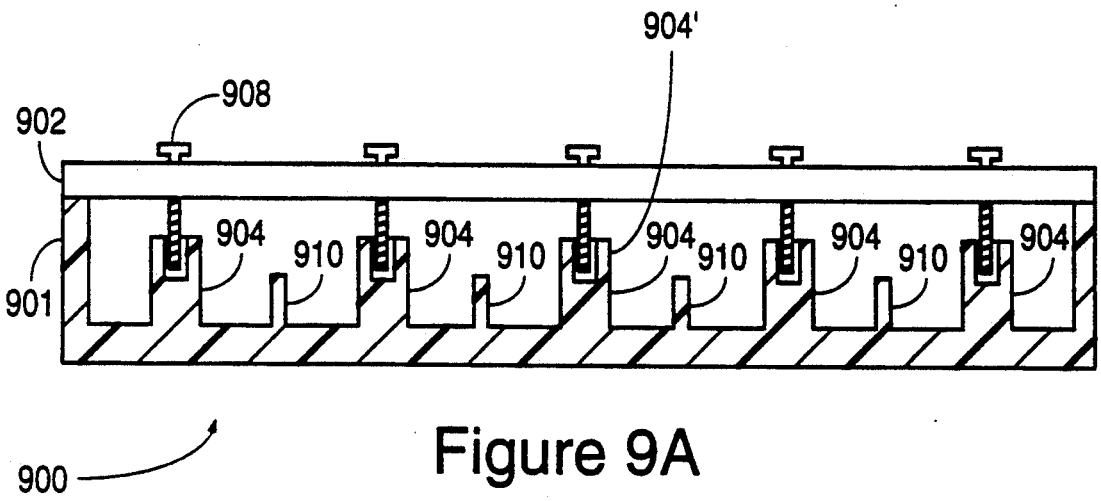
FIGS. 9A and 9B illustrate a cross-sectional view and top view, respectively, of a multiplex filter in accordance with the present invention.

In one embodiment of the present invention and referring to FIG. 9A, rods 904 of housing 901 are separated by an electrical wall 910, conventionally called an iris. The height of iris 910 determines the filter bandwidth (either replacing or used in conjunction with the tuning devices 208 in holes 207 (FIG. 2)). Housing 901, rods 904 and irises 910 are molded in one piece in a conventional manner.

Figure 9B:
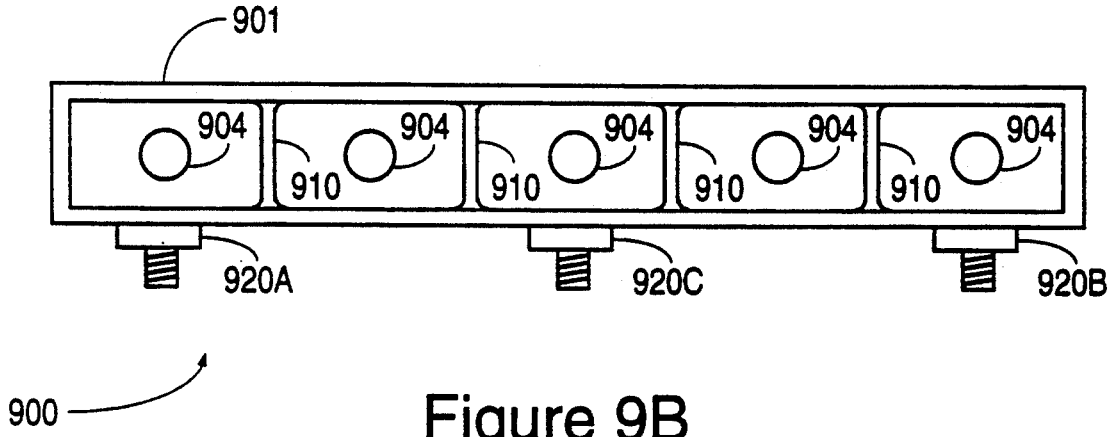

FIG. 9A further illustrates a cross-section of a multiplex filter 900 in accordance with the present invention. During a multiplex operation, a single resonator 904' simultaneously receives or transmits a plurality of signals. FIG. 9B illustrates a top view of filter 900 (FIG. 9A without cover 902) with connectors 920 (see FIGS. 8A–8C for typical methods of coupling these connectors to the rods of the filter).

Figure 10A:
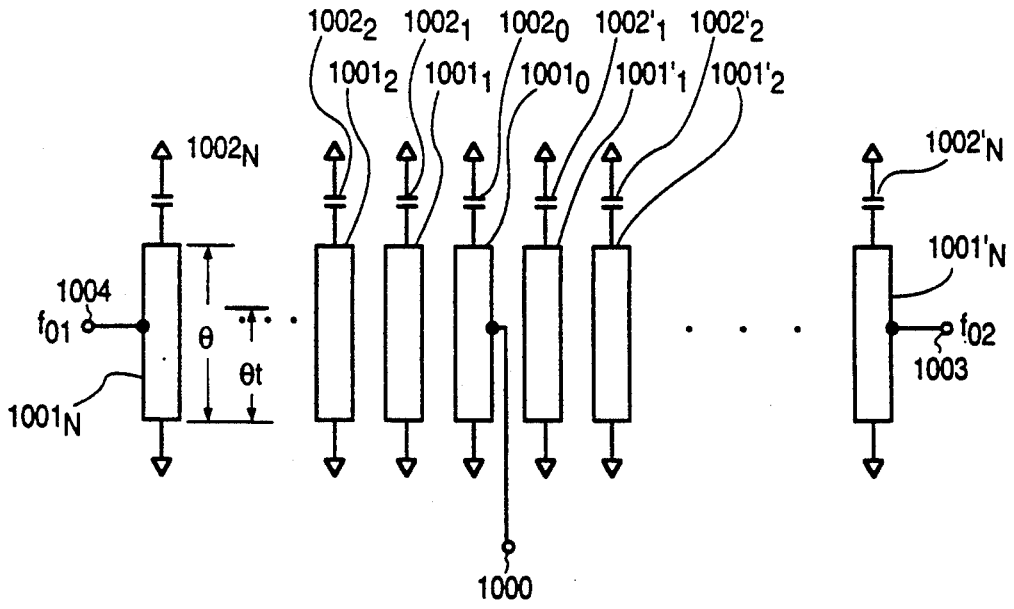
FIG. 10A shows an equivalent circuit of a multiplex filter in the present invention.

FIG. 10 illustrates an equivalent circuit of a multiplex filter in accordance with the present invention. Referring to FIGS. 9B and 10, input signals $f_{o1}$ and $f_{o2}$ are provided to filter 900 via connectors 920A and 920B, respectively. Connectors 920A and 920B correspond to junctions 1004 and 1003, respectively, which are shown in FIG. 10A. The coaxial resonators as provided by plated rods 904 in FIG. 9B correspond to shorted transmission lines 1001 in FIG. 10A. Capacitors 1002 represent the capacitance between the coaxial resonators provided by plated rods 904 (FIG. 9B) and tuning devices 908 (FIG. 9A). An output signal is provided at junction 1000 which corresponds to connector 920C in FIG. 9B. It is well known to those skilled in the art that each transmission line 1001 has an electrical length $\theta$ and that transmission lines $\mathbf{1001}_N$, $\mathbf{1001}_O$, and $\mathbf{1001'}_N$ each have a tap point length $\theta_t$ which typically varies between transmission lines. The multiplexing configuration shown in FIG. 10A is conventionally referred to as a common resonator diplex configuration.

Figure 10B:
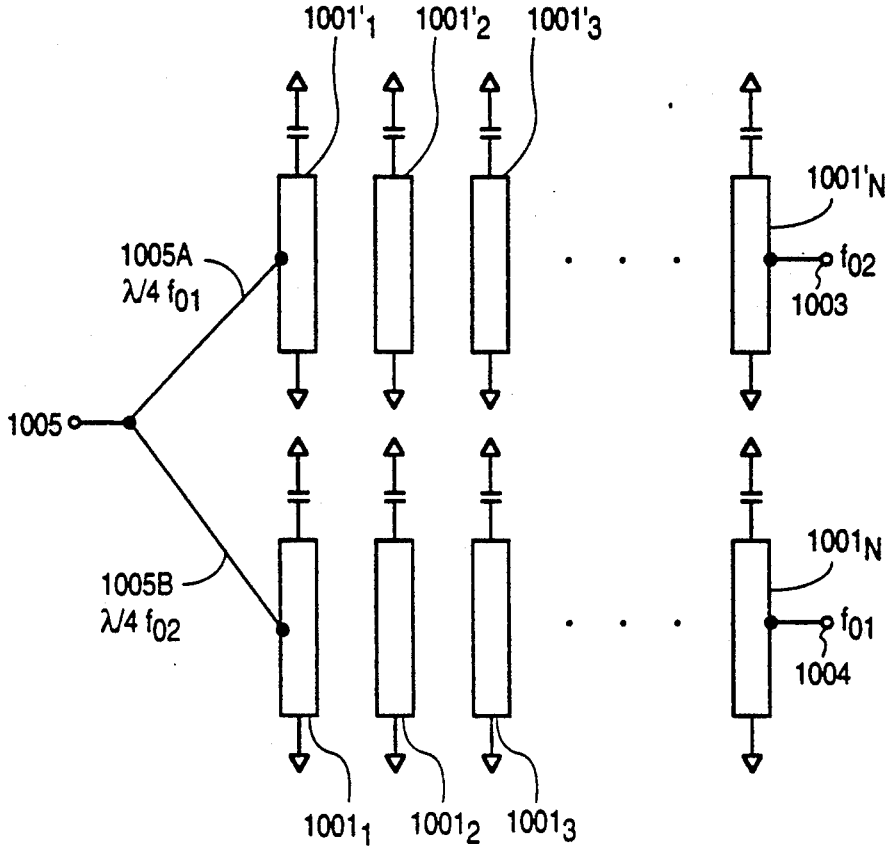
FIG. 10B illustrates an equivalent circuit of a quarter-wave diplex filter configuration.

FIG. 10B shows a quarter wavelength ($\lambda/4$) diplex configuration in which the line 1000 and transmission line $\mathbf{1001}_o$ (FIG. 10A) are replaced by transmission line 1005A which carries a quarter wavelength($\lambda/4$) at $f_{01}$ and transmission line 1005B which carries a quarter wavelength($\lambda/4$) at $f_{02}$. A more detailed description of the quarter wavelength ($\lambda/4$) diplex configuration is given by *Lines, Waves and Antennas: The Transmission Of Electrical Energy*, by R. Brown, R. Sharpe, W. Hughes, and R. Post, 2nd Edition, John Wiley and Son, page 174, 1973 which is herein incorporated by reference in its entirety.

The preceding description is meant to be illustrative only and not limiting. For example, although the embodiment illustrated above shows a plurality of resonators in the filter, the present invention operates with only one resonator or with any number of resonators. Those skilled in the art will be able to devise other structures and methods within the scope of the present invention upon consideration of the detailed description and the accompanying drawings. The present invention is set forth in the appended claims.

We claim:

1. A method of forming a coaxial combline filter electronic device comprising the steps of:

molding a first device element of plastic defining a cavity bounded by a bottom wall and a continuous upstanding sidewall, said first device element including a series of spaced aligned open-ended generally cylindrical rods integrally formed with and upstanding from said bottom in an interior of the cavity;

simultaneously molding an integral iris wall between each of said rods;

thereafter plating the interior of the cavity including the bottom wall, the sidewall and exterior and interior surfaces of said rods and said iris walls with a conductive material to form a series of second resonator elements of said device;

placing and securing a conductive cover to said sidewall; and inserting a series of aligned third tuning elements of said device extending from an interior surface of said cover into the open end of respective aligned ones of said rods for tuning the second resonator elements to a desired frequency wherein said first device element, said second resonator elements, said iris walls, and said third tuning elements form said filter electronic device.

2. The method of claim 1 further comprising the step of connecting inlet and outlet terminals to at least two of said rods at opposite ends of said cavity and wherein said first device element is molded with walls having identical thicknesses.

3. The method of claim 2 wherein the plating step provides a continuous electrical signal path within and across said cavity and along the exterior and in the interior surfaces of said rods and to said inlet and outlet terminals.

4. The method of claim 3 wherein said third tuning elements comprise a series of rotatable tuning screws extending through said cover into the open end interior of respective ones of said series of rods.

5. The method of claim 3 comprising the step of preturning the second resonator elements by molding a series of fixed protrusions of different lengths acting as said third tuning elements and integrally extending from an underside of said cover.

6. The method of claim 1 wherein the step of securing the cover comprising snap-fitting the cover on said sidewall.

7. The method of claim 1 wherein the step of plating comprises applying a first metallic layer on said bottom, said sidewall, said rods and said iris walls; and applying a second metallic layer on said first metallic layer.

8. The method of claim 7 wherein said first metallic layer is electroless copper and said second metallic layer is silver.

9. The method of claim 8 wherein said first metallic layer is at least 1 μm thick and said second metallic layer has a thickness of about 16 to 24 μm.

10. The method of claim 1 in which the molding plastic is a glass fiber reinforced polyethermide resin.

11. The method of claim 1 wherein said iris walls are molded integrally upstanding from said bottom to a level below the open end of said rods and extends between immediately adjacent pairs of said rods and wherein the inserting step includes tuning to a bandwidth by movement of said third tuning elements with respect to the iris walls for changing mutual inductance between said rods.

12. The method of claim 1 wherein the inserting step includes air-tuning each of the second resonator elements.

13. The method of claim 1 wherein the inserting step includes dielectric-tuning each of the second resonator elements.

14. The method of claim 1 further including the step of inserting dielectric sleeves into the interior of each of said rods between the interior of the rods and the third turning elements.

15. The method of claim 1 wherein said cover is an aluminum cover.

16. The method of claim 1 including the steps of plastic molding said cover and plating said molded cover with a conductive metallic layer.

* * * * *